US008072210B2

(12) United States Patent
Giordano

(10) Patent No.: US 8,072,210 B2
(45) Date of Patent: Dec. 6, 2011

(54) DETECTING DEVICE OF THE ANGULAR POSITION OF A ROTATING MEMBER OF AN ELECTRIC HOUSEHOLD APPLIANCE

(75) Inventor: Sergio Giordano, Caselle Torinese (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 297 days.

(21) Appl. No.: 12/443,753

(22) PCT Filed: Dec. 6, 2007

(86) PCT No.: PCT/IB2007/003803

§ 371 (c)(1),
(2), (4) Date: Mar. 31, 2009

(87) PCT Pub. No.: WO2008/068604

PCT Pub. Date: Jun. 12, 2008

(65) Prior Publication Data

US 2010/0164486 A1 Jul. 1, 2010

(30) Foreign Application Priority Data

Dec. 6, 2006 (IT) ..... TO2006A0867

(51) Int. Cl.
*G01B 7/30* (2006.01)

(52) U.S. Cl. ..... 324/207.25

(58) Field of Classification Search ..... None
See application file for complete search history.

(56) References Cited

U.S. PATENT DOCUMENTS

| | | | | |
|---|---|---|---|---|
| 3,529,450 | A | 9/1970 | Pellerin | |
| 4,529,934 | A * | 7/1985 | Heinrich | 324/207.25 |
| 5,602,472 | A * | 2/1997 | Bergstedt et al. | 324/207.25 |
| 5,742,160 | A * | 4/1998 | Bergstedt et al. | 324/207.25 |
| 6,750,575 | B2 * | 6/2004 | Wright | 310/68 B |
| 7,421,865 | B2 | 9/2008 | Lee et al. | |
| 7,891,257 | B2 * | 2/2011 | Giordano | 73/861.77 |

FOREIGN PATENT DOCUMENTS

| | | | |
|---|---|---|---|
| DE | 19948622 | A1 | 5/2000 |
| EP | 1544342 | A2 | 6/2005 |
| EP | 1916528 | A2 * | 4/2008 |
| FR | 2522343 | A1 | 9/1983 |

OTHER PUBLICATIONS

Translation of DE19948622A1 filed on May 4, 2000.*
ISR for PCT/IB2007/003803 dated Apr. 25, 2008.

* cited by examiner

*Primary Examiner* — Jermele M Hollington
(74) *Attorney, Agent, or Firm* — Lowe Hauptman Ham & Berner LLP

(57) ABSTRACT

A detecting device for detecting the angular position of an electric household appliance rotating member, including a generating apparatus of a magnetic field arrangeable in a fixed position with respect to the rotating member; an interaction apparatus with the magnetic field generating element integrally arrangeable in use on the rotating member in a position so as to transit periodically in front of the generating apparatus of the magnetic field and in position adjacent to the same to cause a spatial variation of the magnetic field flux lines between a first and a second field configuration; and a signal generating apparatus adapted to generate an electric signal when crossed by the flux lines of the magnetic field.

18 Claims, 1 Drawing Sheet

DETECTING DEVICE OF THE ANGULAR POSITION OF A ROTATING MEMBER OF AN ELECTRIC HOUSEHOLD APPLIANCE

RELATED APPLICATIONS

The present application is based on International Application Number PCT/IB2007/003803 filed Dec. 6, 2007, and claims priority from Italian Application Number TO2006A000867 filed Dec. 6, 2006, the disclosures of which are hereby incorporated by reference herein in their entirety.

TECHNICAL FIELD

The present invention relates to a detecting device for detecting the angular position of an electric household appliance rotating member, in particular the drum of a top-load washing machine or dryer.

BACKGROUND ART

It is apparent that, in particular in top-load washing machines and dryers, or in general in any electric household appliance provided with a rotating member adapted to take a predetermined angular position for allowing unloading or loading, or for providing a specific function of the household appliance itself, it is necessary to accurately detect when the drum or rotating member has taken such predetermined angular position, e.g. in order to stop it accurately in this position by direct controlling the motor means of the rotating member.

It is known from FR-B1-2784403 a detecting device for detecting the angular position of a rotating drum of a top-load washing machine or dryer adapted to allow the stopping of the drum with the loading/unloading opening arranged at the upper tilting top of the electric household appliance; such a device consists in a permanent magnet (or electromagnet) carried facing a RID type sensor by means of a horseshoe-shaped structure which is fixed to the frame of the electric household appliance, outside the tank. The empty space between sensor and magnet is occupied by the pulley of the drive shaft of the drum, on which a ferromagnetic material strip is arranged in predetermined angular position.

When the ferromagnetic material strip periodically passes in the space comprised between sensor and magnet, it alters the magnetic field, allowing the sensor to detect such alteration and consequently emitting an electric signal; such a device is therefore capable of indicating the reaching of a predetermined angular position of the drum, in which the ferromagnetic strip is located between the sensor and the magnet, which are thus intended to be arranged, in use, on opposite sides with respect to the ferromagnetic strip. Such a type of sensor is also possibly adapted to detect the rotation speed of the drum, as described in EP-A-1067232.

The described device presents the drawback of being relatively cumbersome and, above all, of emitting a signal the discrimination of which depends on the distance between sensor and magnet, which may in use vary with respect to the design distance either due to assembly errors, or more simply due to machining tolerances, or due to a deformation of the horseshoe-shaped support which overhangingly carries the sensor and, on the opposite sidethereof, the magnet; therefore, the device according to FR-B1-2784403 is not very reliable.

From DE-C2-3306052 it is further known a device which in order to overcome the aforesaid drawback makes use of two Hall effect sensors arranged in different angular positions operatively associated to a rotating magnet. This second solution, while presenting a higher reliability, presents however a much higher cost and complexity, in addition to a larger size.

DISCLOSURE OF INVENTION

It is therefore the object of the present invention to provide a device for detecting the angular position of an electric household appliance rotating member designed to overcome the aforesaid drawbacks, specifically presenting high reliability, a low cost, a small size and a high assembly ease.

According to the present invention, there is therefore provided a detecting device for detecting the angular position of an electric household appliance rotating member, typically the drum of a top-load washing machine or dryer, as defined in claim 1.

In particular, the aforesaid detecting device comprises generating means of a magnetic field arranged in a fixed position with respect to the rotating member, e.g. integrally mounted on the frame of the electric household appliance; interaction means with the magnetic field generating means, integrally arrangeable in use on the rotating member in a position so as to periodically transit in front of the magnetic field generating means and in position adjacent to the same; and means adapted to generate an electrical signal when they are crossed by flux lines of the magnetic field, integrally arranged with the magnetic field generating means.

According to the invention, the magnetic field generating means are shaped so that the periodical transit of the interaction means causes a spatial variation of arrangement of the magnetic field flux lines between a first and a second field configuration; and the signal generating means are arranged, with respect to the interaction means, on the same side as the magnetic field generating means, but in a position so as to be crossed by the flux lines only in the second field configuration.

According to a first possible embodiment, the magnetic field generating means consist of a permanent magnet having opposite N-S (North-South) poles oriented along an axis which in use intercepts the interaction means, so that in use essentially all the flux lines of the magnetic field generated by the permanent magnet may interact with the interaction means so as to be displaced from the first configuration, in which they close away from the interaction means, to the second configuration, in which they close through the interaction means.

The signal generating means instead comprise an inductor arranged immediately adjacent to the permanent magnet and arranged coaxially to the axis of orientation of the N-S poles of the permanent magnet, and an electric circuit to which the inductor belongs.

In a second embodiment, the magnetic field generating means consist of an electromagnet comprising an electrical winding and a core defining a magnetic circuit comprising at least one first branch at which the electrical winding is located, and at least one second branch, free from electrical winding at which the signal generator means are located; the core is shaped so as to define between the first and second branch of the magnetic circuit an air gap facing in use towards the interaction means and arranged on the same side with respect to the same, at least near which air gap the interaction means periodically transit in consequence of the rotation of the rotating member.

The signal generating means then consist of a Hall effect sensor integrally carried by the core either at or near the second branch of the magnetic circuit, so as to be crossed by the flux lines of the magnetic field only when they close through the air gap, by effect of the transit of the interaction means, and the second branch of the magnetic circuit, in the second field configuration.

In both embodiments, the interaction means consists in at least one element formed by a ferromagnetic material and mountable, either directly or indirectly, in angularly integral manner to the mobile member in a predetermined angular position, such as a metallic foil, a plate, a bracket or insert.

In this manner, it is possible to generate a signal which may be easily discriminated independently of whether the component members of the detecting device are correctly mounted or not; indeed, if a permanent magnet is used, the device, in addition to being extremely cheap and small, emits a signal which varies in on-off manner between zero (no signal—when the ferromagnetic strip is not facing the magnet and the corresponding inductor) and a predetermined maximum value (e.g. 5 V) corresponding to the design value; possible positioning errors which vary in use the distance between magnet and ferromagnetic strip may thus only make the maximum intensity of the signal vary, but however allow to discriminate between a signal (any signal) and no signal.

If an electromagnet is used, the Hall sensor is mounted on the same structure as the electromagnet and is not thus subjected to assembly errors or, in any case, these do not noticeably affect the difference between the (maximum) quantity of flux lines which cross the sensor when the ferromagnetic strip fixed to the rotating member faces the air gap and the quantity of flux lines which cross it (essentially none) when the ferromagnetic strip is instead not facing the air gap.

Finally, in both cases, an extreme ease of assembly is obtained due to the fact that the two main fixed elements of the device (sensor and magnet/electromagnet) are arranged on the same side with respect to the ferromagnetic strip, instead of on opposite sides as in FR-B1-2784403.

BRIEF DESCRIPTION OF THE DRAWINGS

Further features and advantages of the present invention will be apparent from the following description of a preferred embodiment thereof, exclusively provided by way of non-limitative example and with reference to the accompanying drawings, in which.

BEST MODE FOR CARRYING OUT THE INVENTION

Figure 1:
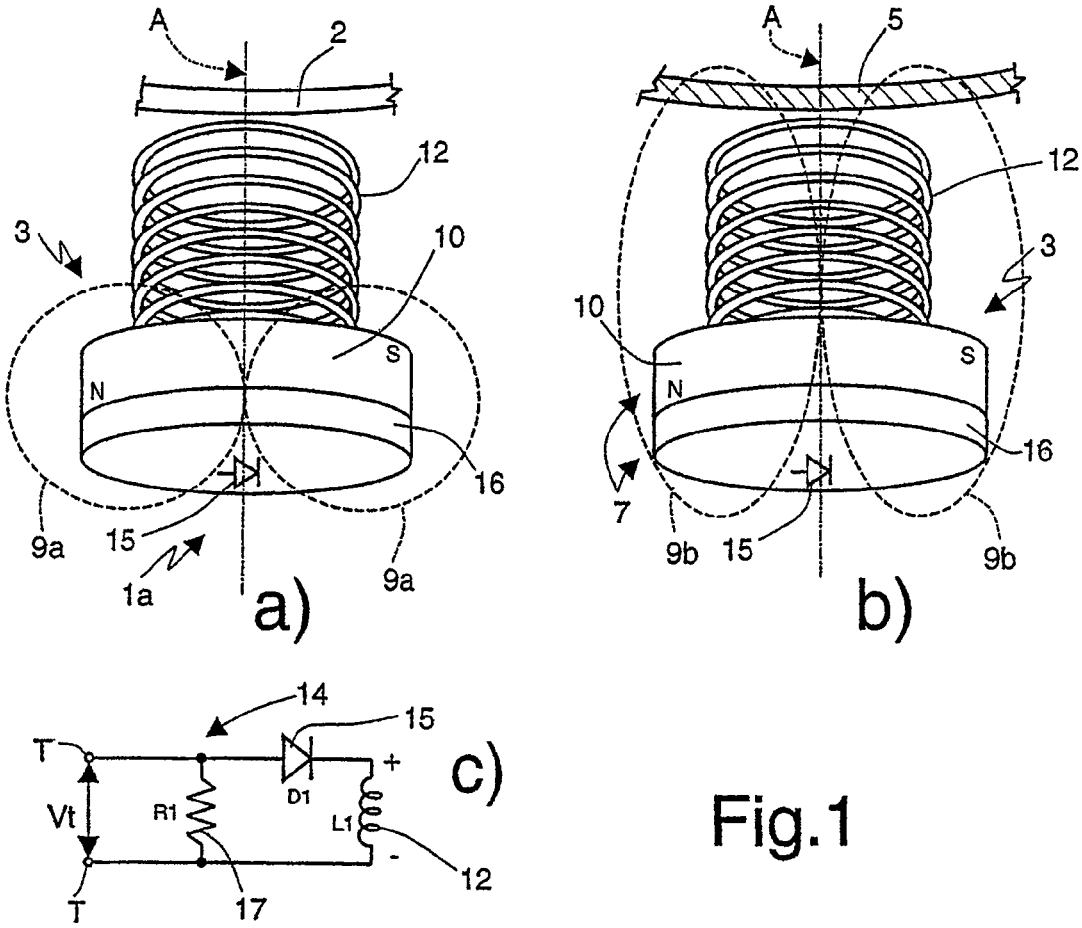
FIG. 1 is a perspective diagrammatic view of a first embodiment of the device according to the present invention in two different configurations a) and b) of operation and, in FIG. 1*c*) shown by a wiring diagram.
Figure 2:
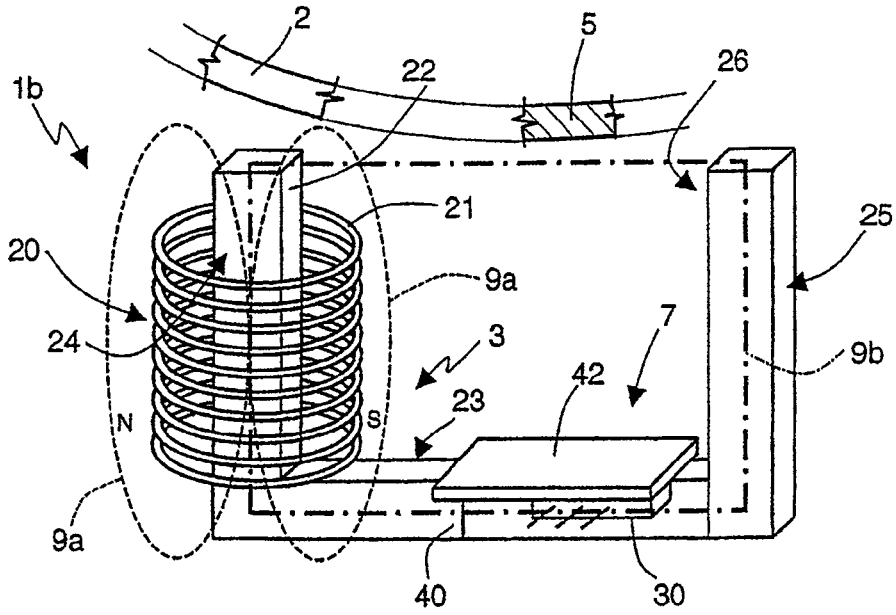
FIG. 2 shows a perspective diagrammatic view of a second embodiment of the device of the invention diagrammatically showing two different operating configurations with different lines.

With reference to FIGS. 1, 2, numeral 1 indicates as a whole a detecting device of the angular position of a rotating member 2 of an electric household appliance (known and not shown). Typically, the rotating member 2 is a drum of a washing machine or dryer, or an element otherwise angularly connected to it, such as the actuating pulley of the drum itself which, on the contrary of the drum, is outside the tank of the washing machine or dryer and is thus in more accessible position.

The device 1, both in version la shown in FIG. 1 and in version 1*b* shown in FIG. 2, comprises generating means 3 of a magnetic field arrangeable in use in a fixed position with respect to the rotating member 2, e.g. integrally mounted onto the frame (not shown) of the electric household appliance in a position peripherally facing the rotating member 2; interaction means 5 with the magnetic field generating means 3, integrally arrangeable in use on the rotating member 2 in a position so as to periodically transit in front of the magnetic field generating means 3, in position adjacent to the same; and means 7 adapted to generate an electric signal when they are crossed by flux lines 9 of the magnetic field, which, as it will be seen later on, may take two different spatial configurations according to the invention. The signal generating means 7 are arranged integrally with respect to the magnetic field generating means 3.

According to an aspect of the invention, the magnetic field generating means 3 are shaped so that the periodical transit of the interaction means 5 causes a spatial variation of the arrangement of the magnetic field flux lines 9 generated by them between a first field configuration, shown in FIGS. 1 and 2 by flux lines 9*a*, and a second field configuration, shown by flux lines 9*b*. In combination with such an aspect of the invention, the signal generating means 7 are arranged with respect to the interaction means 5, on the same side (i.e. on the same band) as the magnetic field generating means 3, but in a position so as to be crossed by the flux lines 9 only in the second field configuration, i.e. so as to be crossed or however operatively associated to the flux lines 9*b* only.

The interaction means 5 are shaped so as to be in use arranged along an angular arc of predetermined width having centre coinciding with a rotation axis (not shown for the sake of simplicity) of the rotating member 2; furthermore, such angular arc of extension of the interaction means 5 is chosen so as to occupy, in use, with respect to the rotating member 2, a predetermined angular position, e.g. either corresponding to, or associated with a desired angular stop position for the drum of the electric household appliance.

In practice, the interaction means 5 consists in at least one element formed by ferromagnetic material and mountable, either directly or indirectly, in angularly integral manner to the mobile member 2 in a predetermined angular position, preferably formed by a metallic foil, a plate, a bracket or insert, angularly fixable to the rotating member 2.

According to the non-limitative embodiment shown in FIG. 1, the field generating means 3 consist in a permanent magnet 10 having opposite poles N-S (North-South) orientated so that in use essentially all the flux lines 9 of the magnetic field generated by the permanent magnet 10 may interact with the interaction means 5 (i.e. with the plate or metallic foil 5 integrally carried by the member 2) to be displaced from the first configuration 9*a*, in which they close away from the plate or foil 5 (FIG. 1*a*)), to the second configuration 9*b*, in which they close through the ferromagnetic plate or foil 5 (FIG. 1*b*)) instead.

The opposite poles N-S of the permanent magnet 10 are in particular orientated along an axis A such that, in use, the axis A always intercepts the interaction means 5 (and with these the member 2), either frontally (being in this case arranged frontally to the rotation axis of the member 2) or radially (being in this case arranged perpendicularly to the rotation axis of the member 2).

According to this embodiment in FIG. 1, the signal generating means 7 comprise an inductor 12 arranged immediately adjacent to the permanent magnet 10 and arranged coaxially to the orientation axis A of the poles N-S of the permanent magnet; and an electric circuit 14 (diagrammatically shown in FIG. 1*c*), to which the inductor 12 belongs.

The electric circuit 14 comprises, in the example shown, in addition to the inductor 12, at least one transistor 15 electrically arranged in series with the inductor 12, and at least one resistor 17, electrically arranged in parallel to both, so as to be adapted to generate at the opposite terminals T, a direct current (dc) voltage signal Vt when the flux lines 9*b* of the magnetic field cross the inductor 12 in the second field configuration (FIG. 1*b*)).

The circuit 12 is preferably carried by an electronic board 16 (printed circuit or PCB) which is glued or fixed in other manner to the permanent magnet on a face of this; on the opposite face of the permanent magnet 10 the inductor 12 is fixed in identical manner, so that it overhangingly protrudes towards the plate or foil 5 from the permanent magnet 10 itself and which is electrically connected to the rest of the electric circuit 14 placed on the board 16 by means of electrical conductors (not shown for the sake of simplicity), e.g. formed by welded wires or conductive tracks, for example deposited on the outside of the permanent magnet 10.

With reference to the embodiment in FIG. 2, the magnetic field generating means 3 consist of an electromagnet 20 comprising an electric winding 21 and a core 22 defining a magnetic circuit 23 comprising at least one first branch 24 at which the electrical winding 21 is located, and at least one second branch 25, free from electrical winding and at which the signal generating means 7 are located.

Specifically, the core 22 is shaped so as to define between the first branch 24 and the second branch 25 of the magnetic circuit 23 an air gap 26 facing in use towards the interaction means 5 and arranged on the same side with respect to the same. In such a manner, the interaction means defined by the plate or foil 5 periodically transits in use, in consequence of the rotation of the rotating member 2, at least in proximity of the air gap 26.

According to this embodiment, the signal generating means 7 then consist of a Hall effect sensor 30 (of known type) integrally carried by the core 23 either at or near the second branch 25 of the magnetic circuit 23, so as to be crossed by the flux lines 9*b* of the magnetic field only when these close through the air gap 26 and the second branch 25 of the magnetic circuit 23 in consequence of the transit in the air gap 26 (or adjacent to the same) of the metallic plate or foil featuring the interaction means 5, forming the mentioned second field configuration.

In practice, the core 22 is U-shaped, having a first and a second straight arms defining the first branch 24 and second branch 25, respectively, of the magnetic circuit 25, and a connection segment 40 between corresponding base ends of the two arms 24, 25; the latter two arms overhangingly protrude from the connection segment 40 and being adapted to be oriented in use towards the rotating member 2; the Hall effect sensor 30 is arranged on the connection segment 40, near the second arm 25, and is mounted integrally to an electronic board 42 for processing the generated signal, also integrally carried by the core 22.

In both illustrated embodiments, when the plate or foil 5 is in an angular position different from that occupied, with respect to the angular position of the rotating member 2, by the magnetic field generating means 3, the generated magnetic field presents the spatial configuration shown by the flux lines 9*a*. In this configuration, both the inductor 12, and the sensor 30 are only marginally affected by the flux lines 9*a* and thus the signal emitted by the circuit 14 is at essentially no voltage (zero value), as the signal emitted by the electronic board 42 will also be essentially zero (or extremely weak).

When the ferromagnetic plate or foil transits near the permanent magnet 10, i.e. in or near the air gap 26, it attracts the flux lines, deforming them and thus obtaining the spatial field configuration shown by the flux lines 9*b*. In virtue of the relative position chosen for the inductor 12 and for the sensor 30, these latter will then be crossed by all or most of the flux lines 9*b*, thus generating a very strong and well defined signal, e.g. a dc voltage Vt of 5 V (FIG. 1) or a signal of defined amplitude and frequency (FIG. 2), in all cases easily discriminable from the situation of practically no signal correlated to the field configuration defined by the flux lines 9*a*.

The invention claimed is:

1. A detecting device for detecting the angular position of an electric rotating member comprising:

a magnetic field generating apparatus arranged in a fixed position with respect to the rotating member;

an interaction apparatus arranged on the rotating member in a position so as to periodically transit in front of the magnetic field generating apparatus; and a signal generating apparatus adapted to generate an electrical signal when the signal generating apparatus is crossed by flux lines of the magnetic field, said signal generating apparatus integrally arranged with the magnetic field generating apparatus; wherein said magnetic field generating apparatus is shaped so that said periodic transit of the interaction apparatus causes a spatial variation of arrangement of the magnetic field flux lines between a first and a second field configuration; and said signal generating apparatus is arranged, with respect to the interaction apparatus, on the same side as the magnetic field generating apparatus, but in a position so as to be crossed by the flux lines only in said second field configuration.

2. The device according to claim 1, wherein said interaction apparatus is arranged along an angular arc of a predetermined width having a centre coinciding with an axis of rotation of the rotating member; said angular arc of the interaction apparatus occupying in use, with respect to the rotating member, a predetermined angular position.

3. The device according to claim 1, wherein said interaction apparatus includes at least one element formed by a ferromagnetic material and angularly integral mountable, in either direct or indirect manner, with the rotating member in a predetermined angular position.

4. The device according to claim 1, wherein said magnetic field generating apparatus includes a permanent magnet having opposite poles oriented so that in use essentially all the flux lines of the magnetic field generated by the permanent magnet interact with the interaction apparatus to displace the flux lines from the first configuration, in which the flux lines close away from the interaction apparatus, to the second configuration, in which the flux lines close through the interaction apparatus.

5. The device according to claim 4, wherein said opposite poles of the permanent magnet are oriented along an axis which in use intercepts the interaction apparatus.

6. The device according to claim 5, wherein said signal generating apparatus comprises:

an inductor arranged immediately adjacent to the permanent magnet and arranged coaxially to said axis of orientation of the poles of the permanent magnet; and an electrical circuit to which the inductor belongs.

7. The device according to claim 6, wherein said electrical circuit comprises:

at least one transistor electrically arranged in series with the inductor, and at least one resistor, electrically arranged in parallel to both said transistor and said inductor, so as to generate a direct current voltage signal when the flux lines of the magnetic field cross said inductor in said second field configuration.

8. The device according to claim 1, wherein said magnetic field generating apparatus comprises an electromagnet including an electrical winding and a core defining a magnetic circuit including at least one first branch at which the electrical winding is located, and at least one second branch, free from electrical winding at which said signal generating apparatus are located;

said core being shaped so as to define between said first and second branches of the magnetic circuit an air gap facing in use towards the interaction apparatus and arranged on the same side with respect to the interaction apparatus, at least near which the interaction apparatus periodically transit in consequence of the rotation of the rotating member.

9. The device according to claim 8, wherein said signal generating apparatus includes a Hall effect sensor integrally carried by said core either at or near said second branch of the magnetic circuit, so as to be crossed by the flux lines of the magnetic field only when the flux lines close, by effect of the transit of the interaction apparatus, through said air gap and the second branch of the magnetic circuit, in said second field configuration.

10. The device according to claim 9, wherein said core is U-shaped, comprising:

a first and a second straight arms defining said first and second branches of the magnetic circuit, and a connection segment between corresponding base ends of the two arms; wherein said two arms overhanging protrude from the connection segment and are oriented in use towards the rotating member; and said Hall effect sensor is arranged on the connection segment, near the second arm.

11. The device according to claim 9, wherein said Hall sensor is integrally mounted on an electronic board for processing the signal that the signal generating apparatus generates.

12. A detecting device for detecting the angular position of an electric household appliance rotating member, comprising:

generating means for generating a magnetic field and arrangeable in a fixed position with respect to the rotating member;

interaction means for interacting with the magnetic field generating means, and integrally arrangeable in use on the rotating member in a position so as to periodically transit in front of the magnetic field generating means and in position adjacent to the magnetic field generating means; and signal generating means for generating an electrical signal when signal generating means is crossed by flux lines of the magnetic field, signal generating means being integrally arranged with the magnetic field generating means; wherein said magnetic field generating means are shaped so as that said periodic transit of the interaction means causes a spatial variation of arrangement of the magnetic field flux lines between a first and a second field configuration;

said signal generating means are arranged, with respect to the interaction means, on the same side as the magnetic field generating means, but in a position so as to be crossed by the flux lines only in said second field configuration;

said magnetic field generating means includes an electromagnet comprising an electrical winding and a core defining a magnetic circuit comprising at least one first branch at which the electrical winding is located, and at least one second branch, free from electrical winding at which said signal generating means are located; and said core is shaped so as to define between said first and second branches of the magnetic circuit an air gap facing in use towards the interaction means and arranged on the same side with respect to the interaction means, at least near which the interaction means periodically transit in consequence of the rotation of the rotating member.

13. A detecting device for detecting the angular position of an electric household appliance rotating member comprising:

generating means for generating a magnetic field and arrangeable in a fixed position with respect to the rotating member;

interaction means for interacting with the magnetic field generating means, and integrally arrangeable in use on the rotating member in a position so as to periodically transit in front of the magnetic field generating means and in position adjacent to the magnetic field generating means; and signal generating means for generating an electrical signal when signal generating means are crossed by flux lines of the magnetic field, signal generating means being integrally arranged with the magnetic field generating means; wherein said magnetic field generating means are shaped so as that said periodic transit of the interaction means causes a spatial variation of arrangement of the magnetic field flux lines between a first and a second field configuration;

said signal generating means are arranged, with respect to the interaction means, on the same side as the magnetic field generating means, but in a position so as to be crossed by the flux lines only in said second field configuration;

said magnetic field generating means includes a permanent magnet having opposite poles oriented so that in use essentially all the flux lines of the magnetic field generated by the permanent magnet interact with the interaction means to displace the flux lines from the first configuration, in which the flux lines close away from the interaction means, to the second configuration, in which the flux lines close through the interaction means;

said opposite poles of the permanent magnet are oriented along an axis which in use intercepts the interaction means; and said signal generating means comprise: an inductor arranged immediately adjacent to the permanent magnet and arranged coaxially to said axis of orientation of the poles of the permanent magnet, and an electrical circuit to which the inductor belongs.

14. The device according to claim 13, wherein said electrical circuit comprises at least one transistor electrically arranged in series with the inductor, and at least one resistor, electrically arranged in parallel to both said transistor and said inductor, so as to generate a direct current voltage signal when the flux lines of the magnetic field cross said inductor in said second field configuration.

15. The device according to claim 12, wherein said signal generating means include a Hall effect sensor integrally carried by said core either at or near said second branch of the magnetic circuit, so as to be crossed by the flux lines of the magnetic field only when the flux lines close, by effect of the transit of the interaction means, through said air gap and the second branch of the magnetic circuit, in said second field configuration.

16. The device according to claim 15, wherein said core is U-shaped, comprising:

a first and a second straight arms defining said first and second branches of the magnetic circuit, and a connection segment between corresponding base ends of the two arms; wherein said two arms overhanging protrude from the connection segment and are oriented in use towards the rotating member; and said Hall effect sensor is arranged on the connection segment, near the second arm.

17. The device according to claim 15, wherein said Hall sensor is integrally mounted on an electronic board for processing the signal the signal generating apparatus generates.

18. The device according to claim 3, wherein said at least one ferromagnetic element is a metallic foil, plate, bracket or insert.

* * * * *